US005131595A

United States Patent [19]

Romagnoli

[11] Patent Number: 5,131,595

[45] Date of Patent: Jul. 21, 1992

[54] AXIALLY DEFORMABLE BOBBIN FOR DYEING SPOOLS

[75] Inventor: Tiziano Romagnoli, Prato, Italy

[73] Assignee: Mariplast S.p.A., Florence, Italy

[21] Appl. No.: 669,112

[22] Filed: Mar. 13, 1991

[30] Foreign Application Priority Data

Mar. 15, 1990 [IT] Italy ..... 11558 B/90

[51] Int. Cl.[5] ..... B65H 75/20; B65H 75/24

[52] U.S. Cl. ..... 242/118.1

[58] Field of Search ..... 242/118.1, 118.11, 118; 68/198

[56] References Cited

U.S. PATENT DOCUMENTS

| | | | |
|---|---|---|---|
| 3,465,984 | 9/1969 | Tigges et al. | 242/118.11 |
| 3,753,534 | 8/1973 | Ono et al. | 242/118.11 |
| 4,270,710 | 6/1981 | Ono | 242/118.11 |
| 4,621,508 | 11/1986 | Baxley, Jr. et al. | 242/118.11 X |
| 4,789,111 | 12/1988 | Thomas et al. | 242/118.1 |
| 4,872,621 | 10/1989 | Thomas | 242/118.11 |
| 4,941,621 | 7/1990 | Pasini | 242/118.1 |
| 4,946,114 | 8/1990 | Becker et al. | 242/118.1 |
| 4,997,141 | 3/1991 | Pasini | 242/118.1 |

*Primary Examiner*—Stanley N. Gilreath
*Attorney, Agent, or Firm*—McGlew & Tuttle

[57] ABSTRACT

A bobbin for dyeing spools possesses an openwork wall on which is wound the yarn for forming the spool, and comprises a plurality of rings (3) which are mutually connected by a series of inclined bridges (5), of greater length than the interspace between contiguous rings (3) and are deformable under the action of the axial compression of the bobbin. The length of the bridges (5) is less than the interspace between two contiguous bridges (5) of a single series of bridges for connecting two consecutive rings (3).

5 Claims, 2 Drawing Sheets

AXIALLY DEFORMABLE BOBBIN FOR DYEING SPOOLS

FIELD AND BACKGROUND OF THE INVENTION

The invention relates to a pliable bobbin for the formation of spools of yarn to be dyed, having at least one section which is plastically pliable in the axial direction under the action of a compressive axial load on the bobbin and in which each pliable section is delimited by two rings which are mutually connected by means of flexible elements.

More specifically, the invention relates to a bobbin for dyeing spools having an openwork wall on which is wound the yarn for forming the spool, formed by a plurality of rings which are mutually connected by a series of inclined bridges, deformable under the action of the axial compression of the bobbin. In a bobbin of this type, which is known for example from EP—A—O, 348, 721, there are also provided—between contiguous rings, or between two parts of a bobbin—elements having a predetermined and limited resistance to the axial load. A bobbin of this type behaves as a rigid bobbin until the axial load applied, thereto exceeds a predetermined value, at which point the section, or at least one section, or a plurality of sections of the bobbin yield as a result of the breaking of the connections, causing a reduction in the axial dimension of said bobbin. In the act of yielding, however, appendages form which may become deformed in an irregular manner and form obstacles either to the manipulations of the bobbin or to the taking-up of the yarn. Moreover, the deformation of the appendages may cause excessive compression of the bobbin and of the spool.

In another known bobbin, only inclined bridges are provided between the contiguous rings forming the bobbin, some of which bridges are provided with enlargements or appendages which limit the axial deformation of the bobbin. When the bobbin is compressed, the appendages produced on said bridges come to press against the contiguous rings of the bobbin, in a manner such that a sufficient passage for dyeing still remains. However, partly because of the elevated temperatures of the dyeing bath in which the compression of the bobbin takes place, the appendages are subject to deformation. The deformation of the appendages causes an excessive axial compression, with a reduction of the dyeing passage, and even in some cases the pinching of the thread, with consequent dyeing defects and disadvantages similar to those of the bobbins of the type described in EP-A-0,348,721.

SUMMARY AND OBJECTS OF THE INVENTION

The subject of the invention is a bobbin which avoids these disadvantages and, in particular, avoids the presence of inwardly and/or outwardly projecting appendages of the bobbin, and other defects and complications of the known bobbins.

These and other objects, which will become apparent to those skilled in the art on reading the text which follows, are achieved by means of a bobbin of the type referred to, in which the length of the bridges is greater than the interspace between consecutive rings and less than the interspace between two contiguous bridges of a single series of bridges for connecting two consecutive rings. The rings forming the bobbin are thus very close together. Under the axial compression, these connections become flexurally deformed and thus permit the rings to move together by the amount determined as a result of the axial pressure, and, as a maximum, up to an amount corresponding to the thickness of said bridges, when the latter come to lie on the rings, nevertheless maintaining a separation between them. Since the length of the bridges is less than the interspace between them, when the bobbin is completely deformed, that is to say when the bridges are completely laid on the contiguous rings, there nevertheless remains between one bridge and the next an aperture sufficient for the passage of the dyeing liquid, without which it would be necessary to resort to spacer appendages, as is the case in the conventional bobbins which are liable to become deformed radially, damaging the yarn.

Advantageously, the ratio between the number of rings and the number of bridges for connection between two consecutive rings is greater than 1, and even greater than 1.5. Further, according to to the invention, the ratio between the number of rings and the number of bridges for connection between two consecutive rings is in the range from 1.5 to 2. This imparts a considerable strength to the bobbin with a very high number of rings and hence deformable sections. Each section defined by two consecutive rings can become deformed only to a limited extent, in that the distance between said rings is short. Consequently, the bobbin as a whole becomes deformed in a more regular manner, in that an overall axial deformation by a certain extent is obtainable only by means of an at least partial deformation of all or virtually all the sections of the bobbin. This is not the case in the conventional bobbins where, because of the longer distance between two contiguous rings, the axial deformation may be entirely localized in one or two sections of the bobbin. This causes evident disadvantages during dyeing, in that the yarn forming the spool is immersed in the dye bath in a non-uniform manner.

Further advantageous embodiments of the bobbin are indicated in the dependent claims.

BRIEF DESCRIPTION OF THE DRAWINGS

The invention will be better understood by reference to the description and the accompanying drawing, which shows a practical, non-limiting embodiment of said invention. In the drawings.

DETAILED DESCRIPTION OF THE PREFERRED EMBODIMENT

In accordance with what is shown in the accompanying drawing, a bobbin 1—which may extend in a cylindrical or more or less slightly conical shape—possesses the lateral wall of circular section formed by a plurality of rings 3 which are essentially brought much closer to each other than in the known conventional solutions, and are mutually connected by inclined bridges 5, which are mutually spaced by an amount greater than the extent or length of each bridge. At the base is provided an annular zone 7 which forms a channel for the so-called "stock " of yarn.

Figure 1:
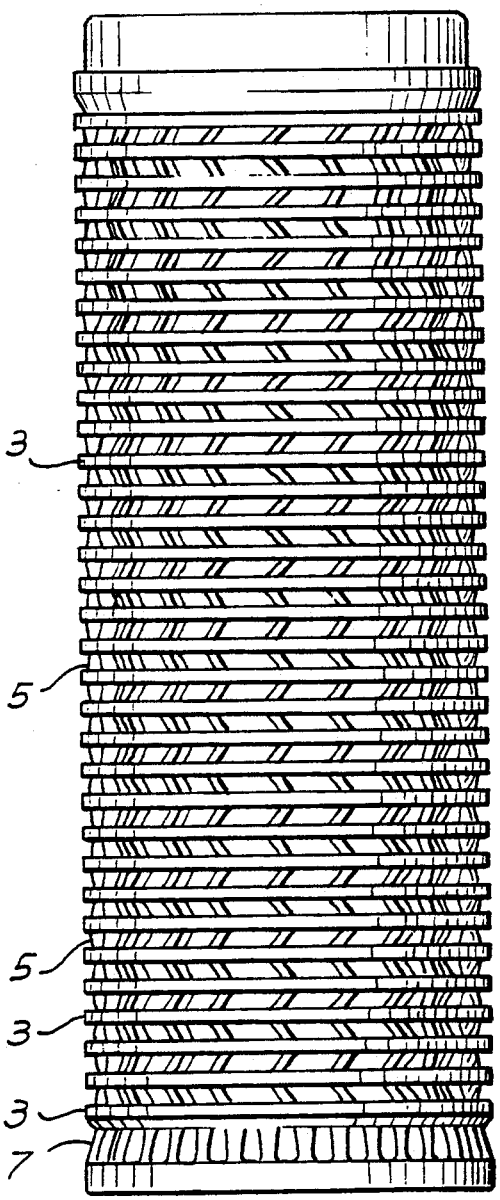
FIGS. 1 and 2 are front views which show a bobbin before and after a reduction of the axial dimension.
Figure 2:
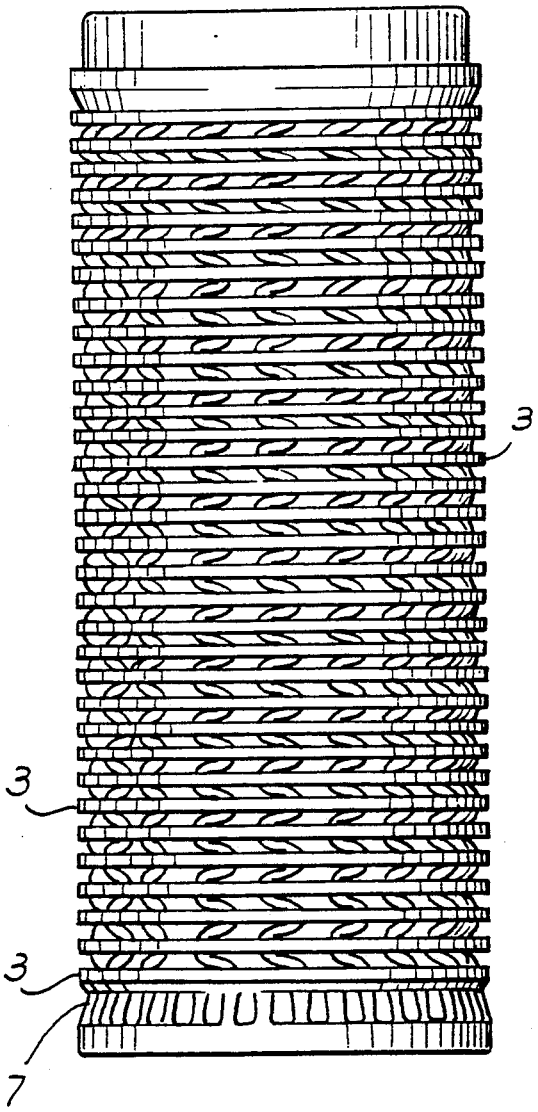

In the normal attitude of the bobbin, undeformed by axial compression (see FIG. 1), the bobbin possesses a regular sieve-like structure defined between contiguous rings 3 and contiguous inclined bridges 5. When, under the action of an axial stress, deformation of the bridges 5 occurs, an axial shortening of the bobbin takes place as a result of the flexural deformation of the bridges 5 of all the interspaces between adjacent rings, the various bridges contained in the gaps between contiguous rings 3 being equal in cross-section, or as a result of deformation only of the bridges contained in some of the interspaces, where the bridges are weaker than in other interspaces. Depending on the axial load imposed, there may be greater or lesser flexural deformation of the bridges and hence variable and predetermined movements together of the rings, stabilizing the position reached. At the limit, the rings 3 may have moved together to an extent which is of the same order of magnitude as the thickness of the bridges, as is clearly shown in FIG. 3, where it is noted that the bridges 5 have—by deformation—adopted an attitude such that the interspace between the contiguous rings 3 is of the same order of magnitude as the width of the bridges 5.

Figure 3:
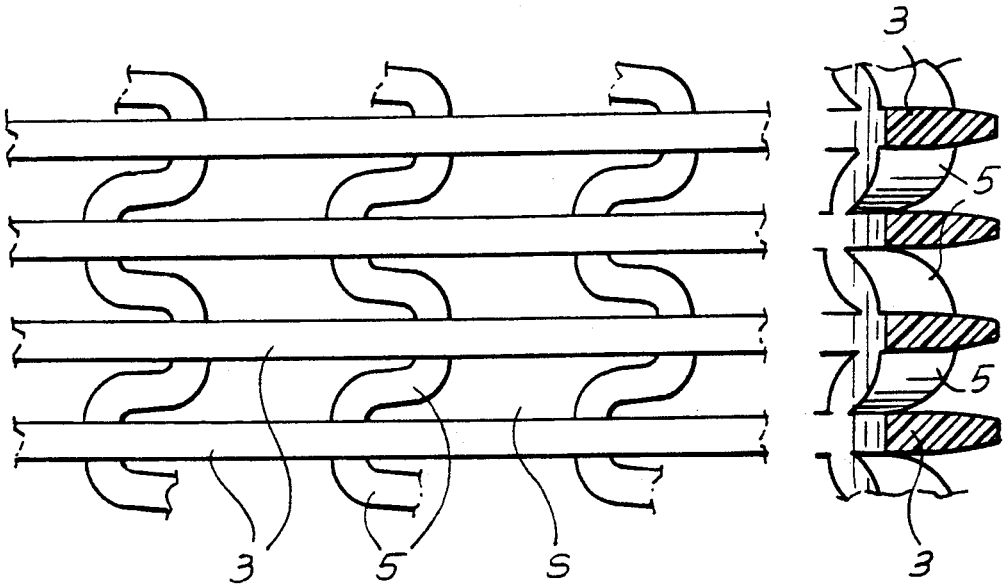
FIG. 3 is a partially schematic partially sectional view which shows a detail of a limit condition of maximum reduction of the axial dimension.

The proportion between the interspace of contiguous bridges and the length of the bridges is such that, even in the attitude shown in FIG. 3, there remains a series of spaces, designated S in said figure, between the outside and the inside of the bobbin, as a result of which it remains possible for liquid to circulate as in the conditions existing prior to axial deformation.

In all cases, the breakage of parts of the bobbin is avoided, and the latter may undergo differing degrees of shortening, which are always maintained constant.

This arrangement of the bobbin achieves extreme simplicity of production, avoids the formation of free appendages which may become deformed in an irregular manner, projecting towards the outside or towards the inside of the bobbin, and also avoids projections which may be caused by the breakage of zones of weakness which are shared in the conventional solutions, in which there is a limit resistance beyond which breakage takes place; all these projections in the conventional solutions may constitute obstacles which impede the operations to be carried out and also impair the integrity of the yarn.

As can be seen in the attached drawing, moreover, the bridges 5 are slightly set back relative to the cylindrical or conical surface defined by the outer walls of the rings 3, and on which surface is wound the yarn with which the spool is formed. In this manner, even in the completely compressed attitude shown in FIG. 3, the yarn is not pinched between the bridges 5 and the rings 3, in that it remains at a distance from said bridges 5. This is also assisted by the reduction in thickness towards the outside possessed by the components 3 and 5, dictated by stamping requirements, as shown in the right-hand part of FIG. 3.

I claim:

1. A bobbin for dyeing spools having an openwork wall on which is wound yarn for forming the spool, comprising:

a plurality of rings arranged adjacent each other, plural series of inclined bridges, each series connecting an adjacent first and an adjacent second ring of said plurality of rings to provide an interspace between adjacent rings, each of said bridges being of a length which is greater than said interspace between adjacent rings, said interspace being variable due to axial compression of the bobbin, said bridges of each series of inclined bridges being spaced apart by a bridge interspace distance, said length of said bridges being less than said bridge interspace distance, said bobbin being constructed such that a ratio between the number of said rings forming the bobbin and the number of said bridges in a series connecting two adjacent rings is greater than one.

2. The bobbin as claimed in claim 1, wherein a ratio between the number of rings and the number of bridges in a series for connection between two adjacent rings is in the range from 1.5 to 2.

3. The bobbin as claimed in claim 1, wherein the bridges are set back relative to the yarn winding surface defined by the rings.

4. A bobbin for dyeing spools having an openwork wall on which is wound yarn for forming the spool, comprising:

a plurality of rings arranged adjacent each other, plural series of inclined bridges, each series connecting an adjacent first and an adjacent second ring of said plurality of rings to provide an interspace between adjacent rings, each of said bridges being of a length which is greater than said interspace between adjacent rings, said interspace being variable due to axial compression of the bobbin, said bridges of each series of inclined bridges being spaced apart by a bridge interspace distance, said length of said bridges being less than said bridge interspace distance, said bobbin being constructed such that a ratio between the number of said rings forming the bobbin and the number of said bridges in a series connecting two adjacent rings is greater than one, wherein the bridges are set back relative to a yarn winding surface defined by an outer surface of said rings.

5. A bobbin for dyeing spools having an openwork wall on which is wound yarn for forming the spool, comprising:

a plurality of rings arranged adjacent each other, plural series of inclined bridges, each series connecting an adjacent first and an adjacent second ring of said plurality of rings to provide an interspace between adjacent rings, each of said bridges being of a length which is greater than said interspace between adjacent rings, said interspace being variable due to axial compression of the bobbin, said bridges of each series of inclined bridges being spaced apart by a bridge interspace distance, said length of said bridges being less than said bridge interpsace distance, said bobbin being constructed such that a ratio between the number of said rings forming the bobbin and the number of said bridges in a series connecting two adjacent rings is greater than one, wherein the bridges are set back a substantial distance relative to a yarn winding surface defined by an outer surface of said rings.

* * * * *